US008408411B2

(12) United States Patent
Hay et al.

(10) Patent No.: US 8,408,411 B2
(45) Date of Patent: Apr. 2, 2013

(54) COLLAPSIBLE PLASTIC CONTAINER

(75) Inventors: Henry F. Hay, Calgary (CA); Sherman McKinniss, Rancho Palos Verde, CA (US)

(73) Assignee: Nova Chemicals (International) S.A. (CH)

( * ) Notice: Subject to any disclaimer, the term of this patent is extended or adjusted under 35 U.S.C. 154(b) by 931 days.

(21) Appl. No.: 11/827,311

(22) Filed: Jul. 11, 2007

(65) Prior Publication Data

US 2009/0014445 A1 Jan. 15, 2009

(51) Int. Cl.

| | |
|---|---|
| ***B65D 6/00*** | (2006.01) |
| ***B65D 8/14*** | (2006.01) |
| ***B65D 6/28*** | (2006.01) |
| ***B65D 8/04*** | (2006.01) |
| ***B65D 8/06*** | (2006.01) |
| ***B65D 8/18*** | (2006.01) |
| ***B65D 90/02*** | (2006.01) |
| ***A01K 1/03*** | (2006.01) |

(52) U.S. Cl. ..... 220/4.29; 220/4.31; 220/6; 220/7; 220/608; 220/666; 220/669; 220/670; 220/671; 119/499

(58) Field of Classification Search ..... 220/6, 4.29, 220/666, 4.31, 7, 608, 669, 670, 671; 119/499
See application file for complete search history.

(56) References Cited

U.S. PATENT DOCUMENTS

| | | | | |
|---|---|---|---|---|
| 3,570,698 | A | 3/1971 | Dougherty | |
| 3,575,312 | A * | 4/1971 | Luisada | 220/1.5 |
| 3,796,342 | A | 3/1974 | Sanders | |
| 3,870,185 | A | 3/1975 | Sanders | |
| 4,214,669 | A | 7/1980 | McQuiston | |
| 4,577,772 | A | 3/1986 | Bigliardi | |
| 4,630,746 | A | 12/1986 | Fortenberry | |
| 4,693,386 | A | 9/1987 | Hughes et al. | |
| 4,848,618 | A | 7/1989 | Yuan | |
| 5,038,953 | A | 8/1991 | Radar | |
| 5,185,193 | A * | 2/1993 | Phenicie et al. | 428/57 |
| 5,190,179 | A | 3/1993 | Richter | |
| 5,253,763 | A | 10/1993 | Kirkley et al. | |
| 5,671,855 | A * | 9/1997 | Norman et al. | 220/1.5 |
| 6,230,916 | B1 | 5/2001 | Bradford et al. | |
| 6,629,899 | B2 * | 10/2003 | Chauvet et al. | 473/472 |
| 6,631,821 | B2 | 10/2003 | Vourganas | |
| 6,726,046 | B2 | 4/2004 | Orset | |
| 6,913,161 | B2 | 7/2005 | Schafer | |
| 7,025,019 | B2 * | 4/2006 | Axelrod et al. | 119/499 |
| 7,083,061 | B2 | 8/2006 | Spindel | |
| 7,137,522 | B2 | 11/2006 | Dubois | |
| 7,175,040 | B2 | 2/2007 | Lorenz | |
| 7,237,689 | B2 | 7/2007 | Maggio et al. | |

FOREIGN PATENT DOCUMENTS

| | | |
|---|---|---|
| CA | 1159379 | 12/1983 |
| CA | 1333055 | 11/1994 |

* cited by examiner

*Primary Examiner* — Anthony Stashick
*Assistant Examiner* — Andrew T Kirsch
(74) *Attorney, Agent, or Firm* — Kenneth H Johnson

(57) ABSTRACT

A collapsible, portable container having a roof, a base, two foldable end walls and two removable side walls. The end walls and side walls of the container are load bearing elements having a twinned wall structure made of rotomolded plastic. The container is collapsed by removing the side walls and inwardly folding the end walls to draw the roof closer to the base. The load bearing capacity of the end walls and the side walls can be increased by arched indentations formed within the twinned wall structure.

10 Claims, 18 Drawing Sheets

COLLAPSIBLE PLASTIC CONTAINER

FIELD OF THE INVENTION

The current invention is directed to collapsible plastic storage containers, in particular to containers made from load bearing rotomolded plastic parts having a twinned wall structure.

BACKGROUND OF THE INVENTION

Collapsible shipping and storage containers are well known in the art. Collapsibility is desirable in order to minimize the space requirements of the container when it is empty and not in use. Collapsibility improves storage and shipping options and mitigates shipping costs.

Collapsible containers typically include removable or foldable side or end walls, a base and optionally a roof. Generally, shipping containers are constructed from wood, metal or plastic parts. Metal containers are durable with high load bearing capacities, but are heavy. Plastic containers are lighter, but are not as durable, are typically much smaller in size and have reduced load bearing capacity. As a result, the storage capacity of plastic containers can be limited.

For example, a collapsible shipping container made of plastic is described in U.S. Pat. No. 4,630,746. Each part of the container has a "meshed" structure made by injection molding. The container has two opposing side walls that are inwardly foldable along a vertically hinged axis. In contrast, U.S. Pat. No. 3,870,185 teaches a collapsible plastic container having side walls that are inwardly foldable along a horizontally hinged axis. The plastic containers taught are not suitable for storage and transport of heavy loads.

A metal container having inwardly folding horizontally hinged side walls is disclosed in U.S. Pat. No. 5,190,179. The container also has end walls that pivot to within the container where they are stored when the container is collapsed. The metal container contains fork lift tines to allow for its movement when collapsed or erected. Other metal containers having similar features are disclosed in U.S. Pat. Nos. 4,577,772, 3,570,698, 4,848,618, and 4,214,669. The weight of these metal containers and their component parts often requires a forklift or other specialized equipment in order to collapse and erect the container, as well as for movement of the containers from one location to another.

In light of the above, there remains a need for a collapsible container having good load bearing properties and high storage capacity but without the added weight or corrosion problems of metal component parts.

SUMMARY OF THE INVENTION

The current invention overcomes the problems associated with the prior art by providing a collapsible container that is relatively lightweight and has a high load bearing capacity.

The current invention provides a collapsible container comprising: a roof; a base; two opposing end walls, each end wall comprising an upper and a lower end wall panel pivotally attached to the roof and the base respectively, the upper end wall panel being horizontally pivotally attached to the lower end wall panel to permit inward folding of each end wall; two opposing removable side walls fitting between the roof and the base; the end walls and the side walls being a twinned wall load bearing structure defined by inner and outer wall members made of plastic; whereby the container is collapsible by removing the side walls and inwardly folding the end walls to draw the roof toward the base.

In an embodiment of the invention, the side walls and the end walls are rotomolded plastic components.

In an embodiment of the invention, at least one of the side walls and end walls has a plurality of concave indentations forming an internal arch between the inner and outer wall members of the twinned wall structure.

In an embodiment of the invention adjacent edges of the end walls and the side walls engage each other through mating tongue and groove formations.

In an embodiment of the invention the side walls are partitioned into at least two removable side wall panels.

In an embodiment of the invention the side wall panels of the container engage the roof and base along their upper and lower edges respectively by a complimentary tongue and groove means. The tongue and groove means allows each side wall panel to slidably engage the roof and the base.

In an embodiment of the invention the tongue and groove means between the side wall panels and the roof has a section dimensioned to loosely engage a side wall panel aligned with the section, so that each side wall panel can be removed from the container when aligned with the section.

In an embodiment of the invention the base has a recessed area that holds each of the side wall panels when the container is collapsed.

In an embodiment of the invention the container has a locking means that prevents removal of a side wall panel that is aligned with a section dimensioned to loosely engage a side wall panel.

In an embodiment of the invention the base has depending tine slots.

In an embodiment of the invention the roof has protrusions that are complimentary to the tine slots so that a plurality of containers can be stacked one on top of the other without slippage.

The inventive containers are collapsible to minimize space requirements during transport, and are easily moved without requiring specialized equipment.

The inventive containers are weatherproof and stackable when collapsed or erected.

DETAILED DESCRIPTION

The current invention describes collapsible plastic containers having improved storage and load bearing capacity.

In the current invention, the use of the terms "end wall" and "side wall" is arbitrary and is used only to distinguish one set of opposing container walls from the other. It will be recognized by a person skilled in the art that the side walls can be designated as the end walls and vice versa and that the side walls can be the same length as the end walls, or they may be longer or shorter than the end walls.

The terms "mate" or "mating edges" includes complimentary tongue and groove means, interlocking offset edges, abutting offset edges and the like, but does not include abutting parallel edges.

The term "removable" is meant to encompass container components that are in their entirety removable from the container without an attachment point to any other component of the container. In contrast, the term "integral" is meant to encompass container components that have at least one point of attachment to at least one other component of the container regardless of their orientation or configuration.

Figure 1A:
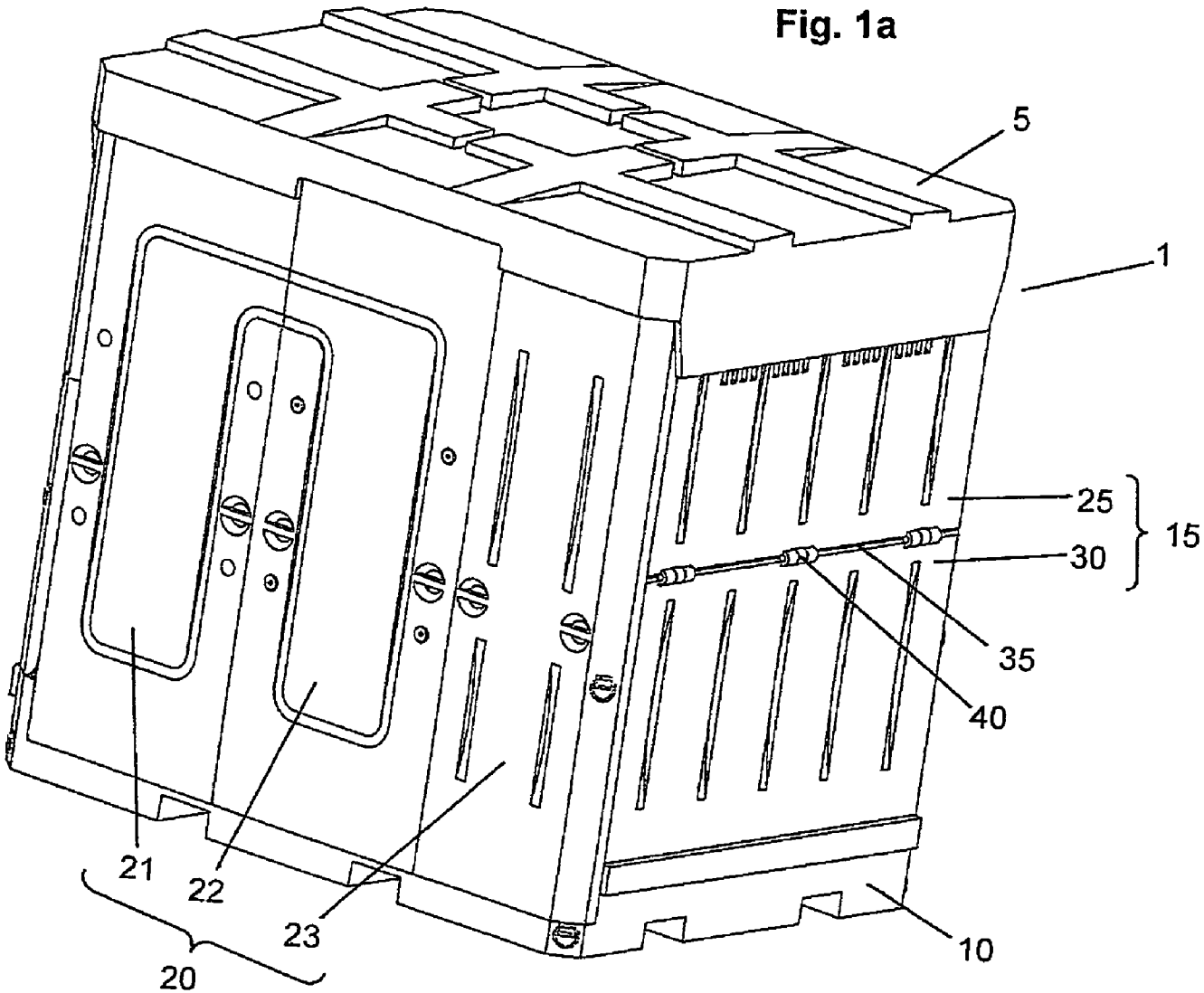
FIG. 1*a* shows a perspective view of an embodiment of the current invention.

FIG. 1*a* shows a preferred embodiment of the current invention. The container 1 has a roof 5, a base 10, two opposing integral end walls 15, and two opposing removable side walls, 20. The opposing end walls are each comprised of an upper end wall panel 25 and a lower end wall panel 30 pivotally attached to the roof 5 and the base 10 respectively. The upper end wall panels 25 are pivotally attached to lower end wall panels 30 along a horizontal axis 35 by hinges 40. The axis 35 extends horizontally across the vertical midpoint or centre of the end walls 15. The side walls 20 which are fully removable fit between and engage the roof 5 and the base 10.

Figure 2:
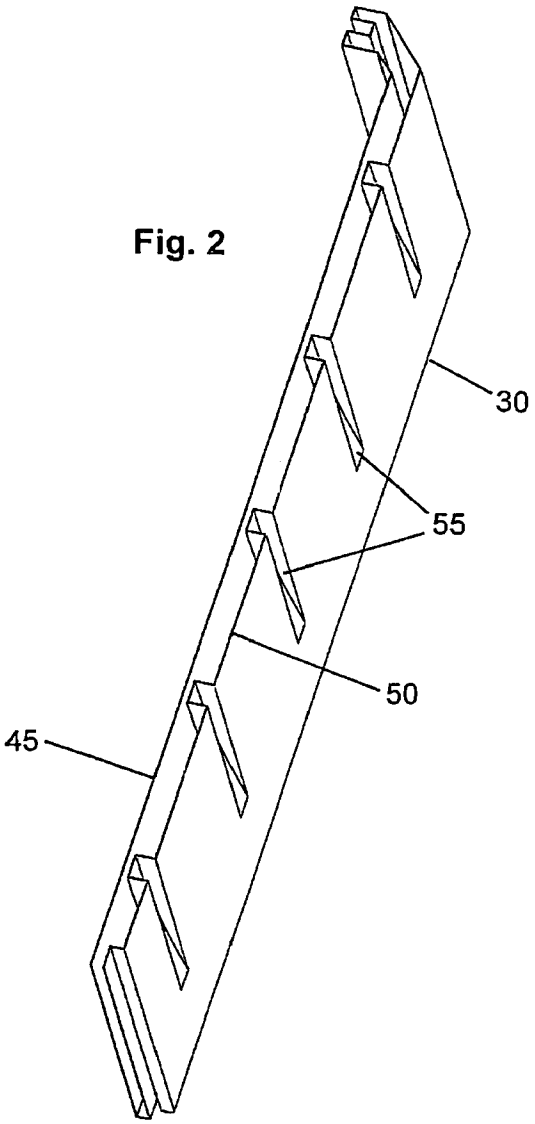
FIG. 2 shows a cross sectional perspective view of a lower end wall panel in an embodiment of the current invention.

In a preferred embodiment the ends walls and the side walls are rotomolded plastic parts having a twinned wall structure defined by an inner wall member 45 and an outer wall member 50. The roof and base are also preferably made of rotomolded plastic and optionally have a twinned wall structure. The twinned wall structure has a void space between inner and outer wall members 45 and 50 respectively as shown in FIG. 2.

Rotomolding techniques are well known in the art and are particularly well suited to the production of large or hollow plastic parts having complex shapes.

Figure 1B:
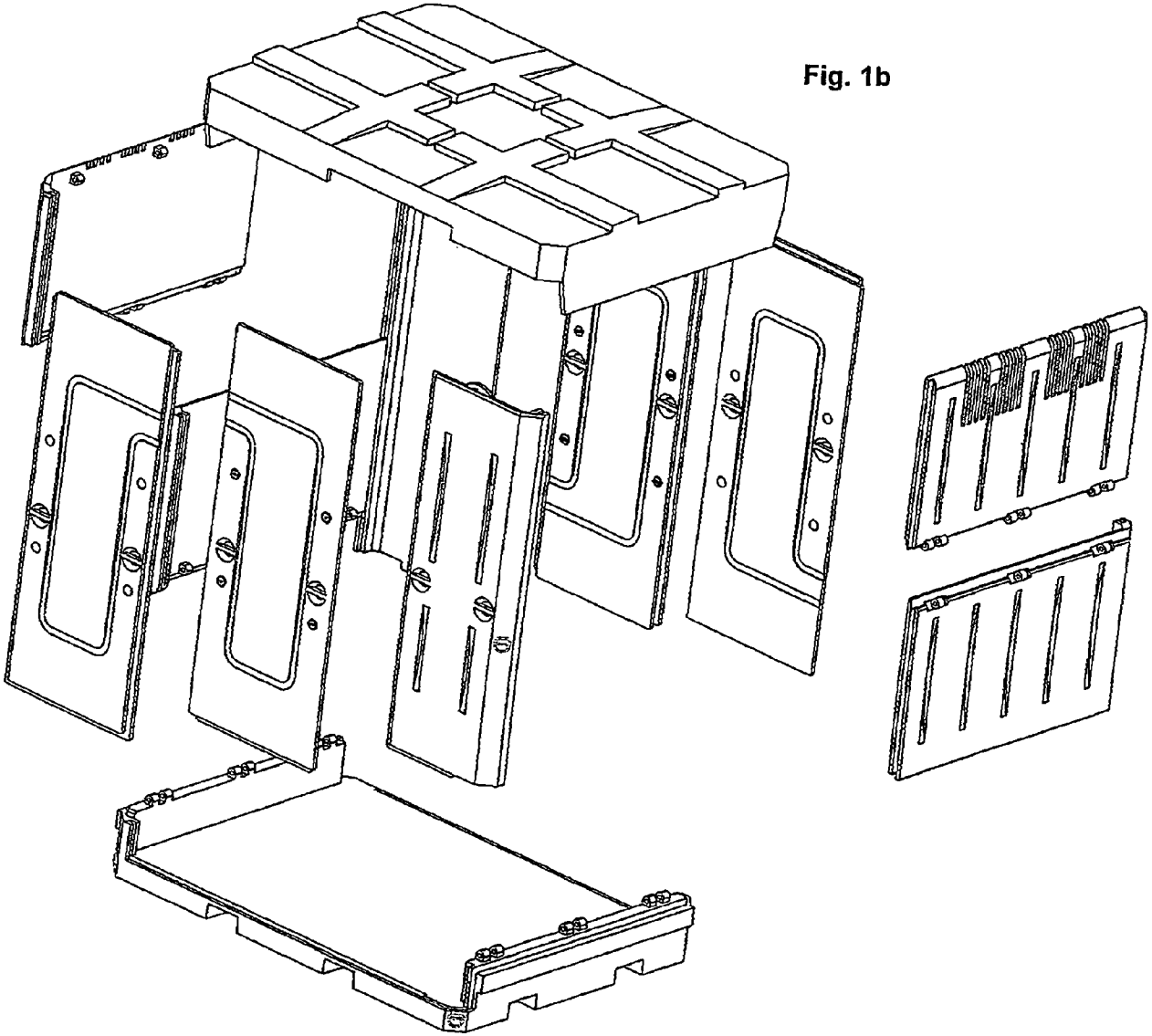
FIG. 1*b* shows an exploded perspective view of an embodiment of the current invention.
Figure 3:
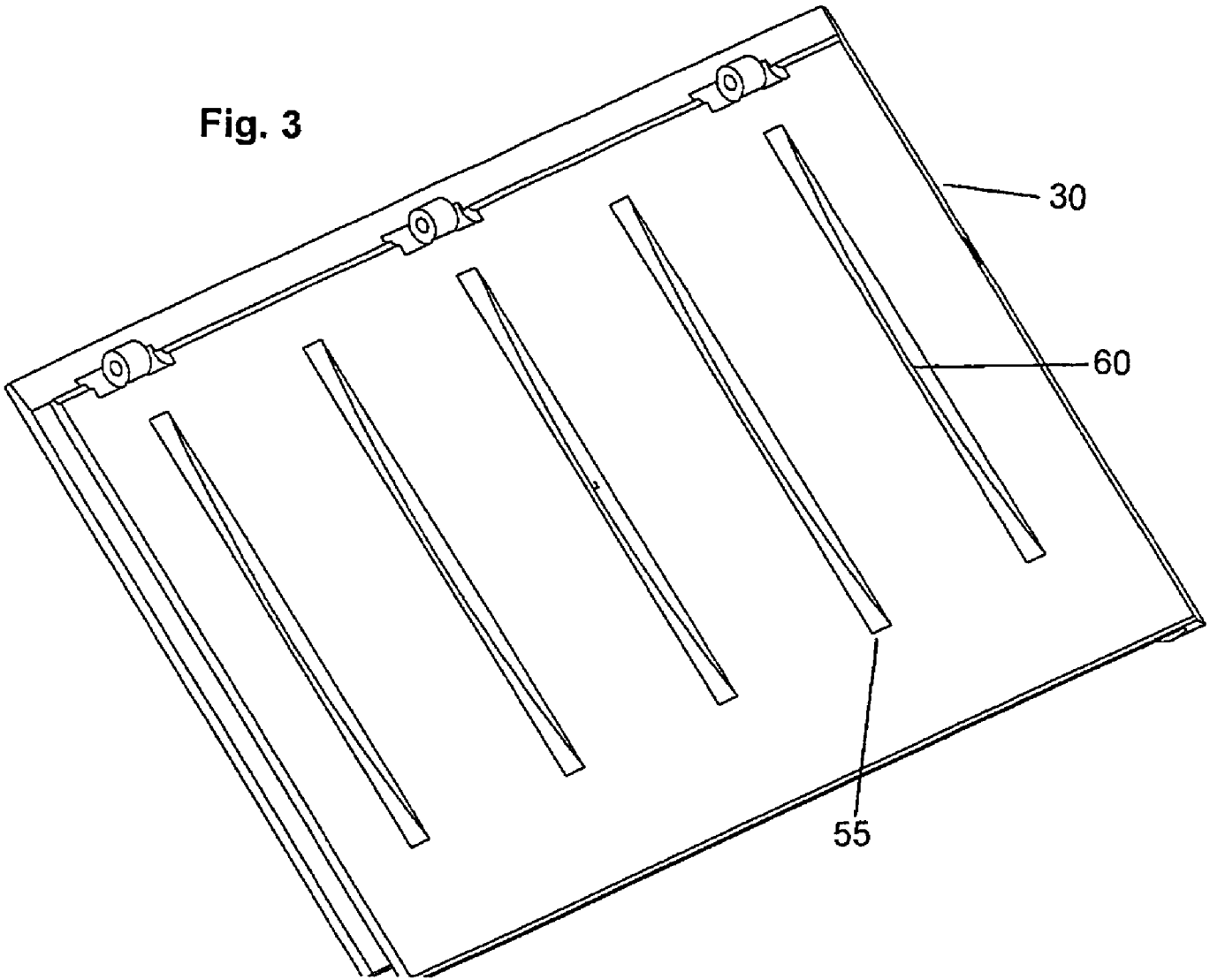
FIG. 3 shows a perspective view of a lower end wall panel in an embodiment of the current invention.

With reference to FIG. 3, the load bearing capacity of the side walls and the end walls can be increased by incorporating a plurality of concave indentations 55, each indentation forming an internal arch, 60 between inner 45 and outer wall 50 members. As shown in FIGS. 1 and 3, the concave indentations 55 are substantially vertical. It will be recognized by a person skilled in the art that the concave indentations can face inward as when in the outer wall member, or outward as when in the inner wall member. A combination of inward and outward facing concave depressions is also contemplated by the current invention. Also, with reference to FIGS. 1, 2, 3, 7, 8, and 11, the concave indentations 55 are each of increasing depth as their vertical mid-point is approached. Hence, at least one of the side walls and the end walls has a plurality of elongate, arcuately concave indentations 55, each of which independently forms a substantially vertical internal arch 60 between the inner and outer wall members.

Without wishing to be bound by theory, the arches defined by the concave indentations provide an internal "roman arch" which resists deformation of the walls by compression forces. As the walls are compressed, the internal arch resists inward or outward flexing of the walls in a direction approximately perpendicular to the direction of the compression forces.

In a preferred embodiment of the current invention, the side walls 20 are partitioned into at least two removable side wall panels having mating or abutting adjacent edges.

Preferably, the side wall panels have upper and lower edges that engage the roof and base respectively by a complimentary tongue and groove means. The tongue and groove means allows each side wall panel to slidably engage the roof and the base.

In a preferred embodiment of the invention, the end walls 15 and the side walls 20 engage each other along mating tongue and groove formations. The formations may have any suitable shape, provided that a groove within the tongue and groove formation of an end wall or a side wall is in alignment with a tongue within the tongue and groove formation of an adjacent side wall or end wall respectively.

Figure 4A:
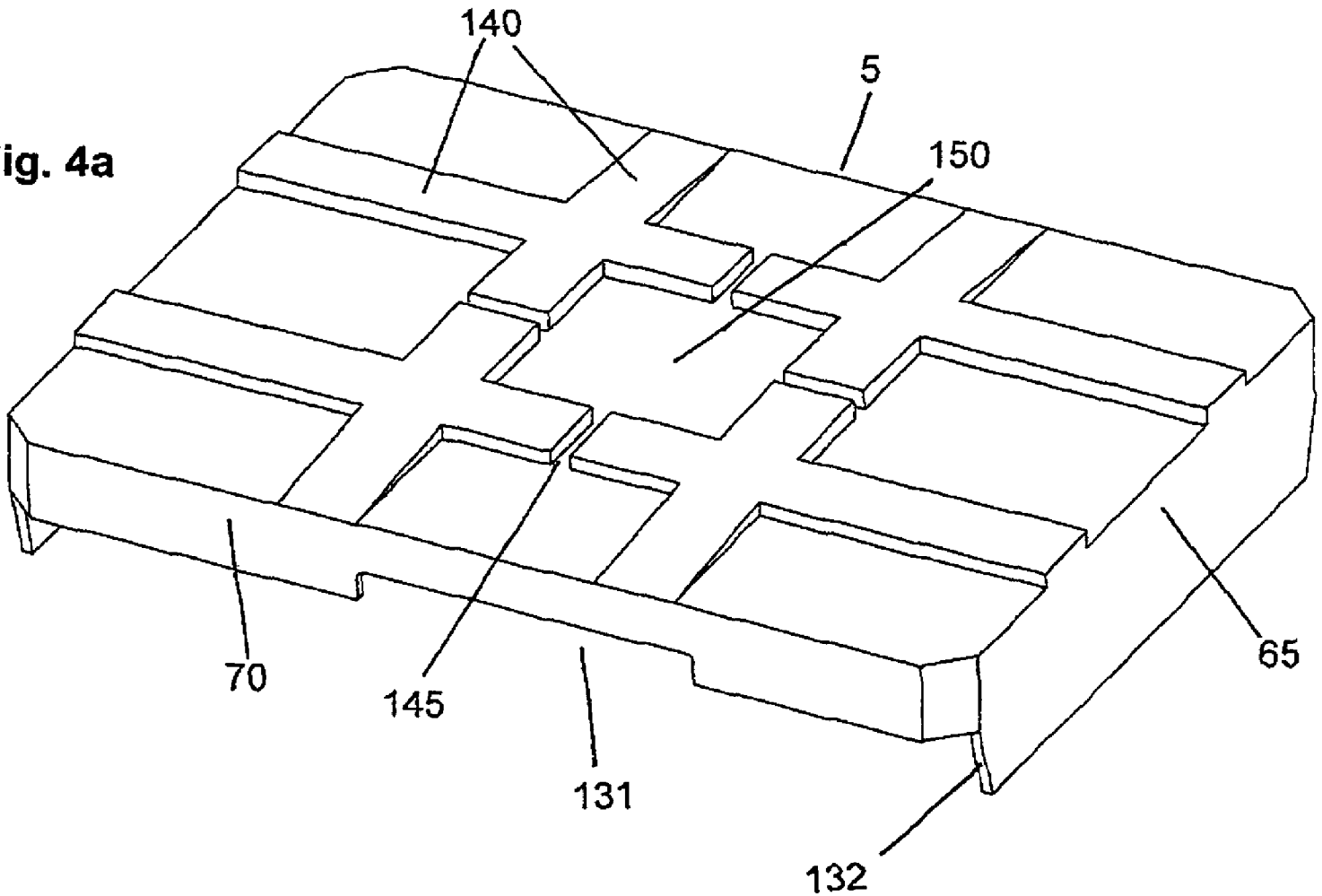
FIGS. 4*a* and 4*b* show perspective views of the roof in an embodiment of the current invention.
Figure 4B:
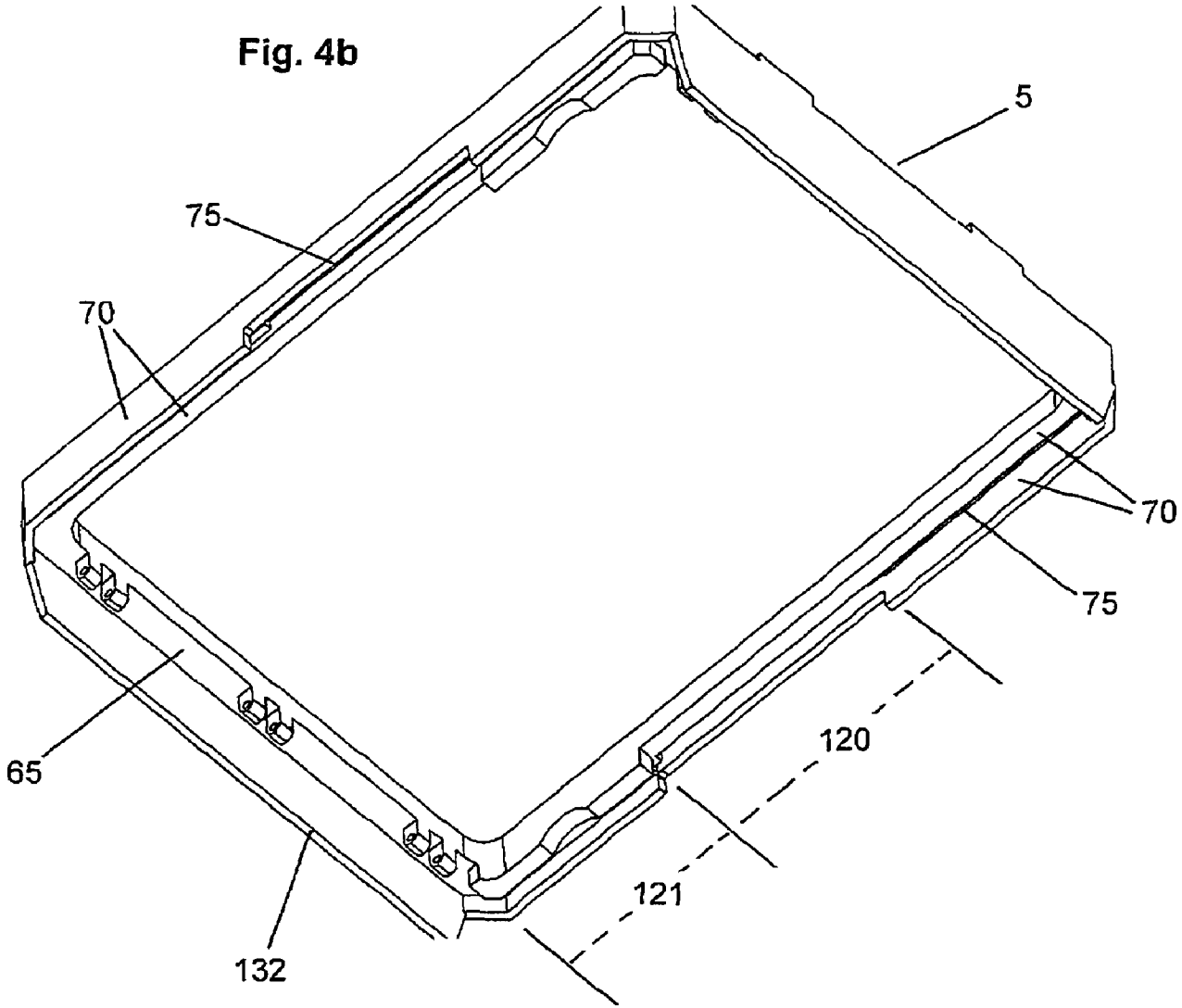

With reference to FIGS. 4*a* and 4*b*, the roof 5 has two downwardly extending end skirting walls 65. The upper end wall panels 25 are pivotally attached to the end skirting walls by one or more hinges 41. Similarly, the roof 5 has two downwardly extending side skirting walls 70 which engage the side walls 20. There is an upper groove 75 disposed in each downwardly extending side skirting wall. The upper grooves 75 form part of a tongue and groove means between the side wall panels and the roof.

Figure 5A:
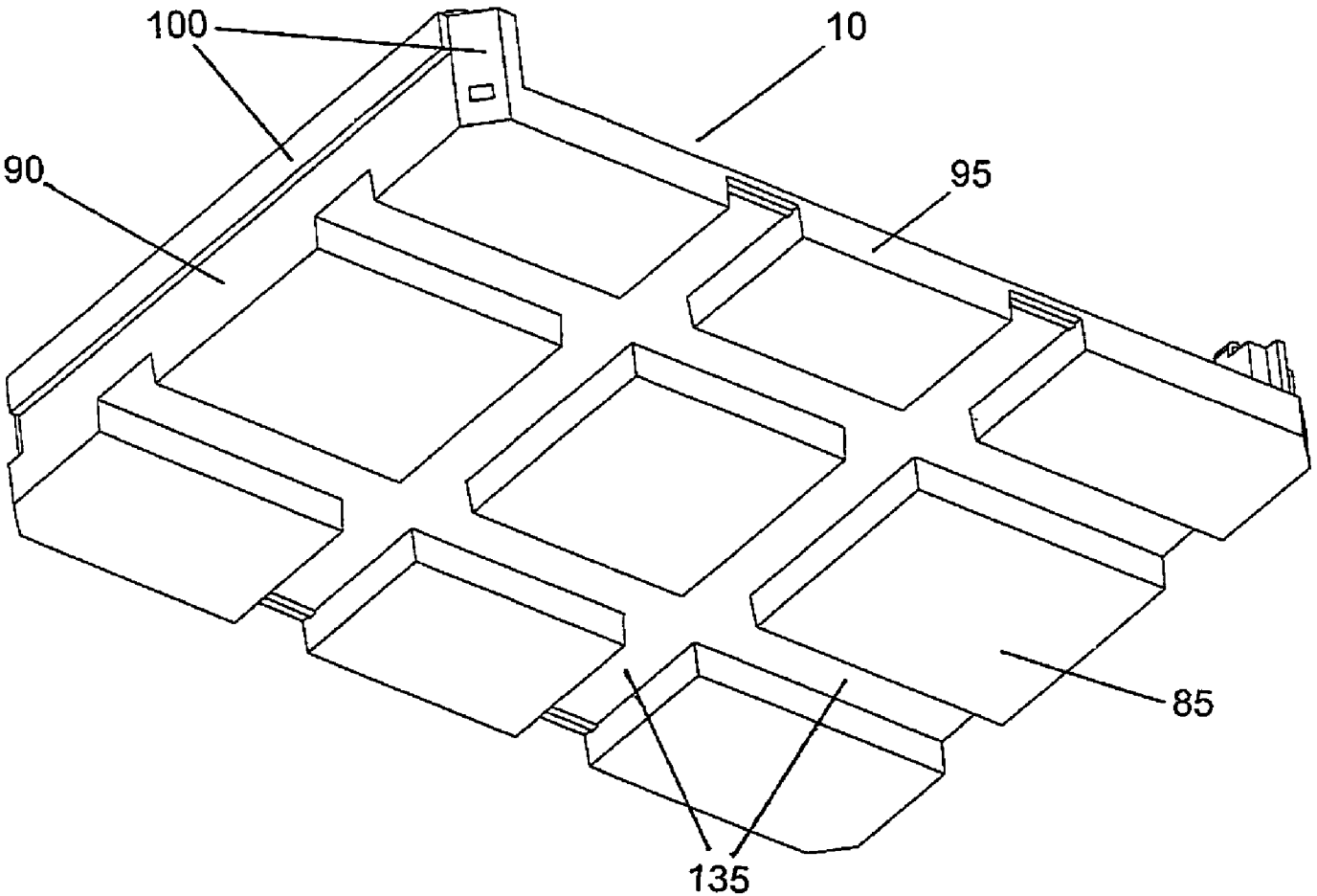
FIGS. 5*a* and 5*b* show perspective views of the base in an embodiment of the current invention.
Figure 5B:
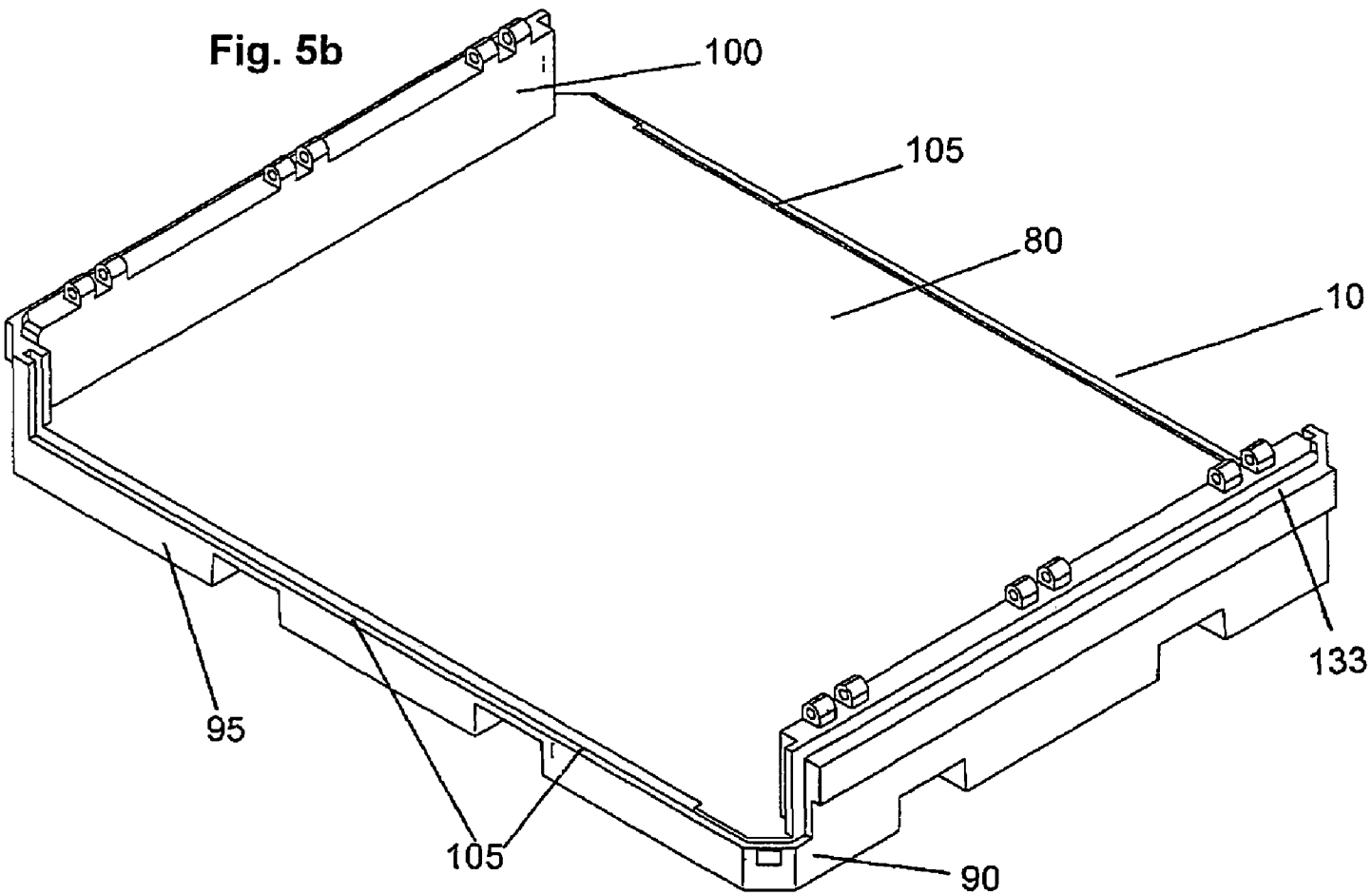

With reference to FIGS. 5*a* and 5*b*, the base 10 has spaced apart top and bottom surfaces 80 and 85 joined by a pair of base end walls 90 and a pair of base side walls 95. The base also has two upwardly extending end retaining walls 100. The top surface 80 that is between the end retaining walls 100 provides a recessed area for storing side wall panels. The lower end wall panels 30 are pivotally attached to the end retaining walls 100 of the base by hinges 42. The base has a pair of lower grooves 105. Each lower groove is disposed in the top surface 80 of base 10 adjacent to each base side wall 95. The lower grooves 105 form part of a tongue and groove means between the side wall panels and the base.

In a preferred embodiment the base has a plurality of "kiss offs". The term "kiss off" refers to a point in a twinned wall component at which the inner and outer wall members 45 and 50 pinch together to make contact with one another. Use of "kiss offs" in other parts of the collapsible container 1 is also contemplated by the current invention. It is well known in the art that "kiss offs" increase the structural rigidity and strength of a twinned wall component.

In a preferred embodiment, each side wall panel has a pair of offset perimeter edges that slidably engage upper grooves 75 and lower grooves 105 in the side skirting walls 70 of roof 5 and the upper surface 80 of base 10 respectively.

A reversed tongue and groove means, in which grooves present in the upper and lower edges of the side wall panel slidingly mate with a tongued track on the roof and base respectively, is also contemplated by the current invention.

Figure 6:
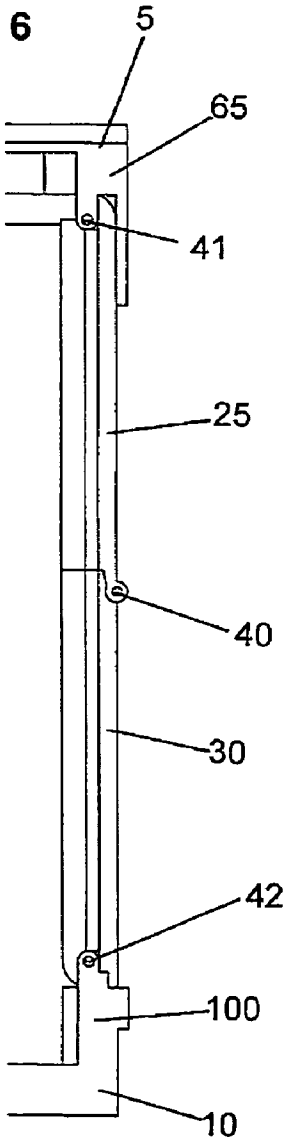
FIG. 6 shows a cross sectional elevation view of the roof, end wall and base in an embodiment of the current invention.
Figure 7:
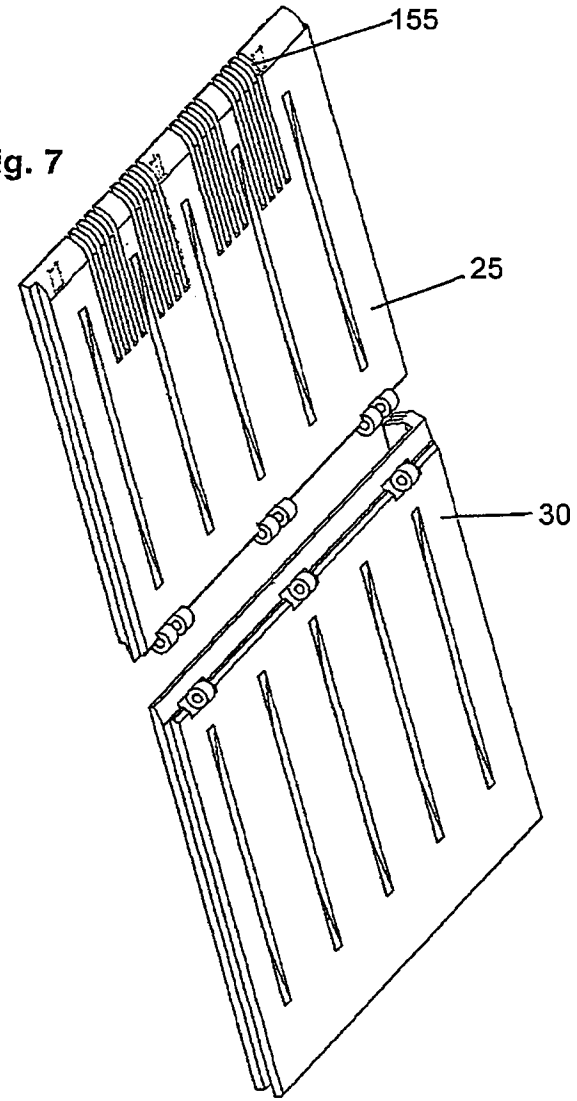
FIG. 7 shows an exploded perspective view of an end wall in an embodiment of the current invention.

With reference to FIG. 6, the upper end wall panels 25 are pivotally attached to the end skirting walls 65 by one or more than one offset hinge 41. The lower end wall panels 30 are pivotally attached to the retaining walls 100 of the base by one or more than one offset hinge 42. The upper end wall panels are horizontally pivotably attached to the lower end wall panels by one or more than one offset hinge 40.

The upper end wall panels 25 and the lower end wall panels 30 have abutting or mating adjacent edges. In a preferred embodiment, an outwardly offset pair of lower edges on the upper end wall panels 25 mate with an inwardly offset pair of upper edges on the lower end wall panels 30 when the container is erect, as shown further in FIGS. 7 and 8. This configuration of mating offset edges prevents water from entering the container along the horizontal axis 35 and provides a stop against the outward folding of the end walls beyond a substantially vertical position.

Figure 8:
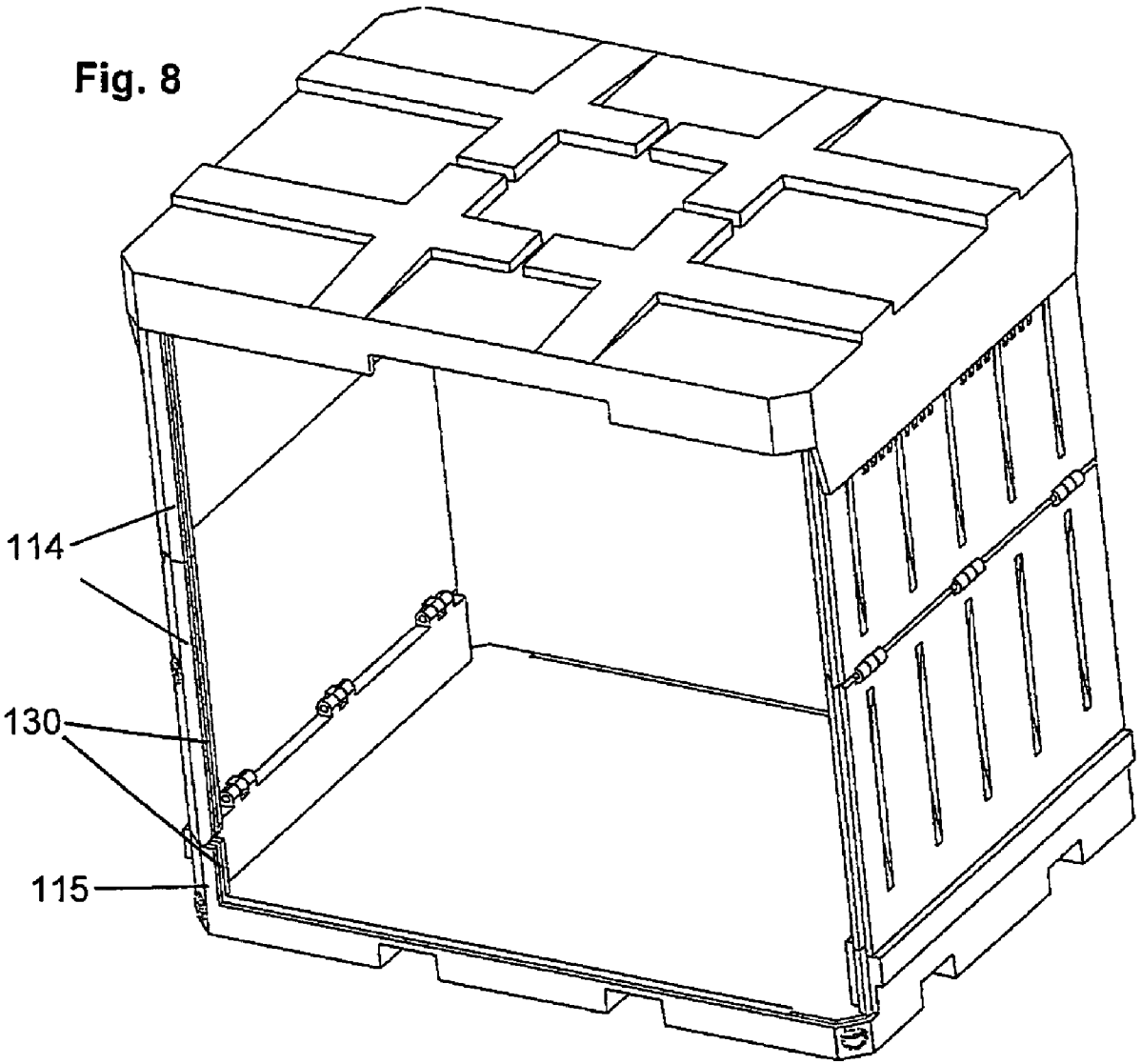
FIG. 8 shows a perspective view of an embodiment of the current invention.
Figure 9:
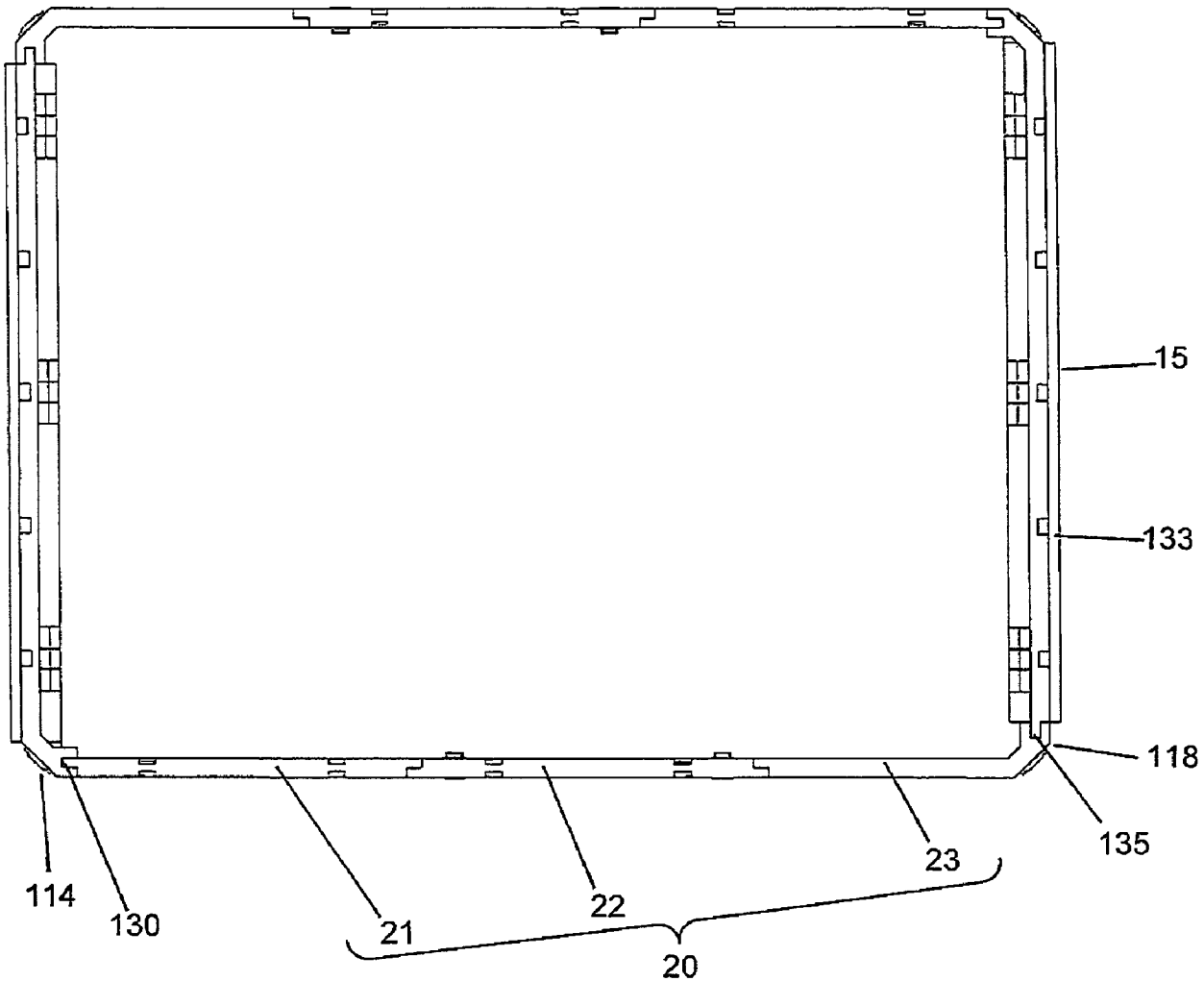
FIG. 9 shows a cross sectional plan view of the end walls and side walls of an embodiment of the current invention.

With reference to FIGS. 8 and 9, the end walls 15 and the retaining walls 100 have on one lateral side, perpendicular corner extensions 114 and 115 respectively which mate with an edge of an adjacent side wall 20 to define a pair of vertical corner sections. The corner extensions 114 and 115 have a first lateral groove 130 disposed therein which mates with an edge of an adjacent side wall 20. Non-mating, abutting adjacent edges can also be used as can a reversed tongue and groove interaction, in which the groove, 130 is present in an adjacent edge of the side wall.

Figure 10A:
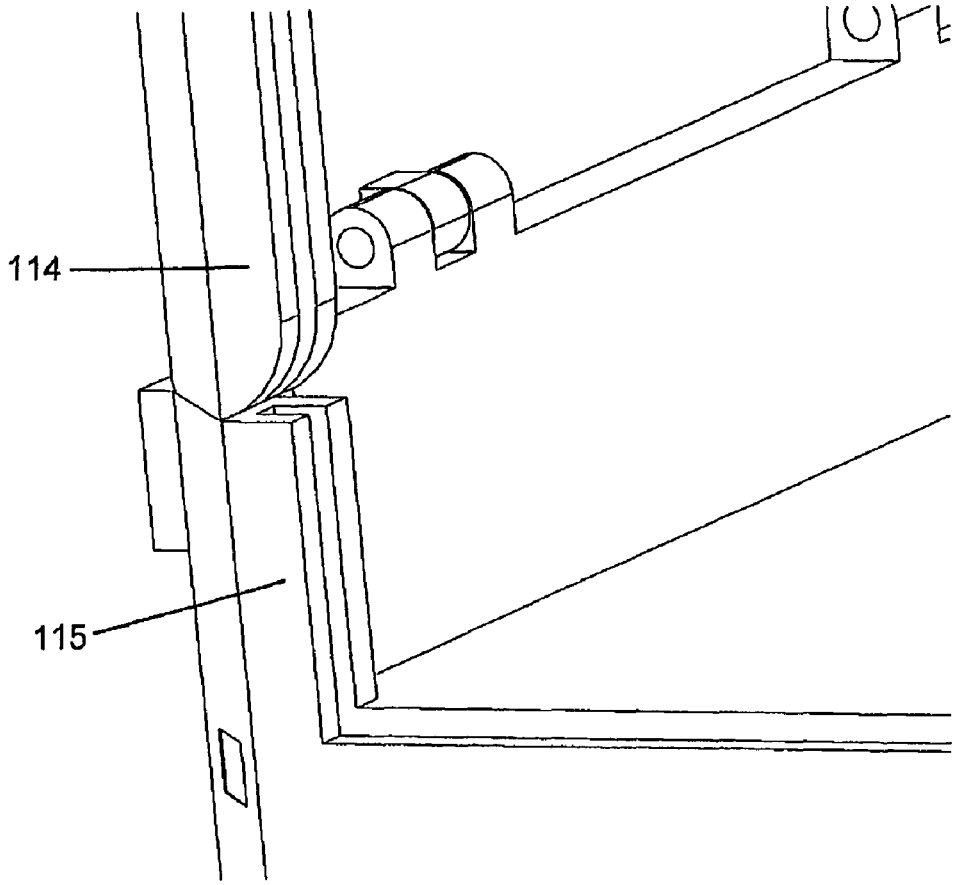
FIG. 10*a* shows a partial perspective view of an embodiment of the current invention.
Figure 10B:
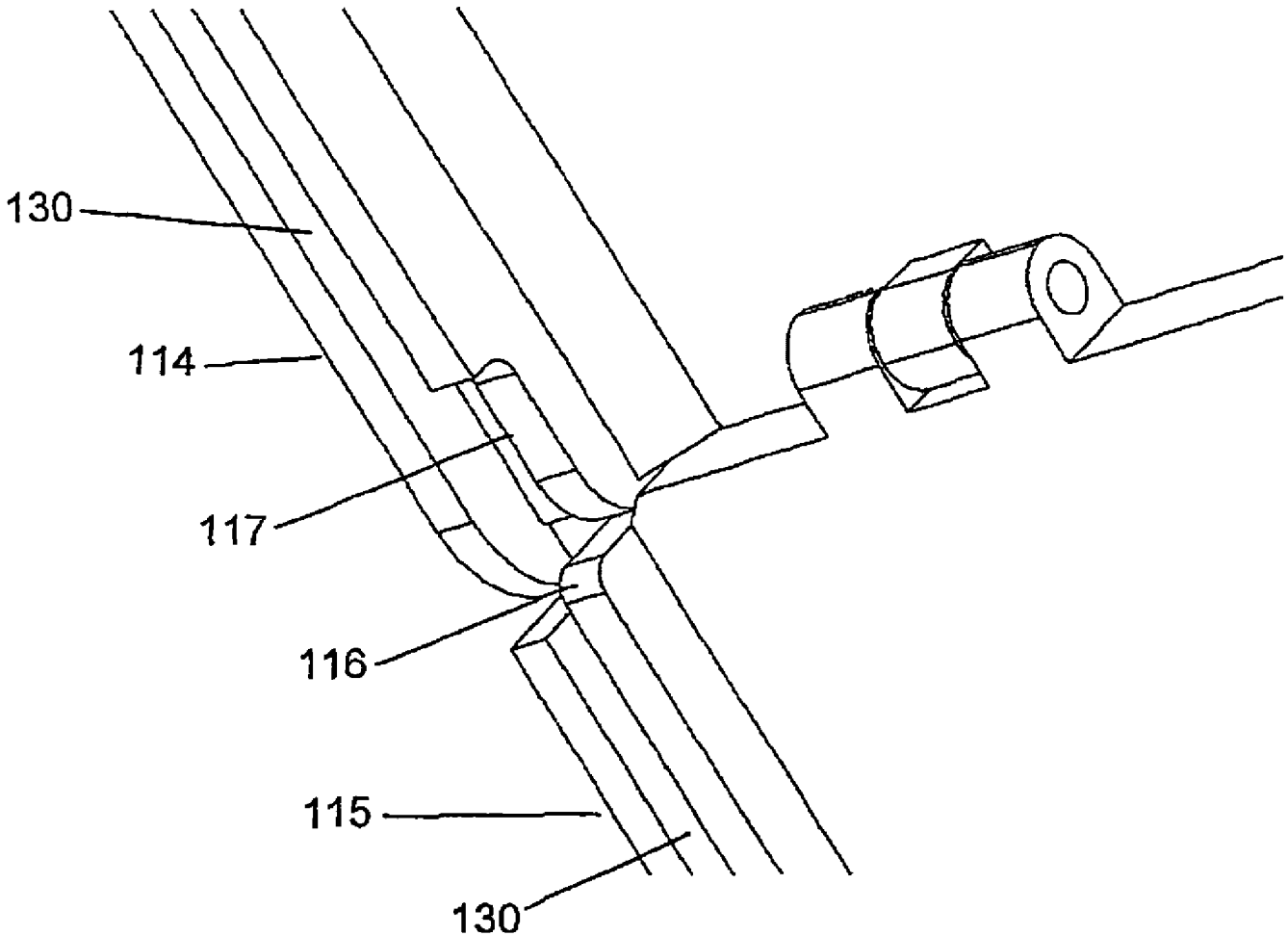
FIG. 10*b* shows a partial perspective view of an embodiment of the current invention.

To facilitate inward folding of the end walls along axis 35, the corner extensions 114 on upper and lower end wall panels 25 and 30, have beveled upper and lower ends respectively. The corner extension 115 on the end retaining walls have a squared upper end. In one embodiment of the invention, the corner extensions 114 and 115 on the lower end wall panels and the end retaining walls respectively have adjacent beveled and squared end surfaces which evenly abut one another as shown in FIG. 10*a*. This arrangement leaves a small space between corner extensions 114 and 115. Preferably, the corner extensions 114 and 115 on the lower end wall panel and the end retaining wall respectively have adjacent beveled and squared end surfaces which abut one another unevenly as shown in FIG. 10*b*. The upper end of corner extension 115, inward of grove 130, has an upwardly extending portion 116 which overlaps with the space between corner extensions 114 and 115, outward of groove 130, providing additional weatherproofing for erected container 1. The corner extension 114 on the lower end wall panel 30 has a cutout 117 inward of groove 130, which mates with the upwardly extending portion on corner extension 115 when the container is collapsed.

With reference to FIG. 9, the side walls 20 have on one lateral side a perpendicular corner extension 118 which mates with an edge of an adjacent end wall 15 to define a second pair of vertical corner sections. The corner extensions 118 have a second lateral groove 135 disposed therein which mates with an edge of an adjacent end wall 15. Non-mating, abutting adjacent edges can also be used as can a reversed tongue and groove interaction, in which the groove, 135 is present in an adjacent edge of the end wall.

As shown in FIGS. 1 and 9, each of the side walls 20 can be partitioned into first 21, second 22 and third 23 sequentially adjacent side wall panels. First and second side wall panels, 21 and 22 are generally flat, while the third side wall panel 23 has an L-shaped cross section the short side of which defines corner extension 118. The first 21 and second 22 side wall panels have a pair of offset perimeter edges that slidingly engage the upper groove 75 and the lower groove 105. An edge of the first wall panel 21 also engages the first lateral groove 130 in corner extensions 114 and 115 of an adjacent end wall and retaining wall respectively. The first and second side wall panels are equivalent but flipped relative to one another so that adjacent offset edges of the first side wall panel and the second side wall panel mate with one another. The perpendicular corner extension 118 of the third side wall panel 23 has disposed therein a second lateral groove 135 which mates with the edge of an adjacent end wall. The side wall panel 23 also has a pair of offset perimeter edges that mate with an adjacent edge of the second door panel 22, with the lower groove 105 of the base 10 and with the upper groove 75 of the roof 5.

Figure 11:
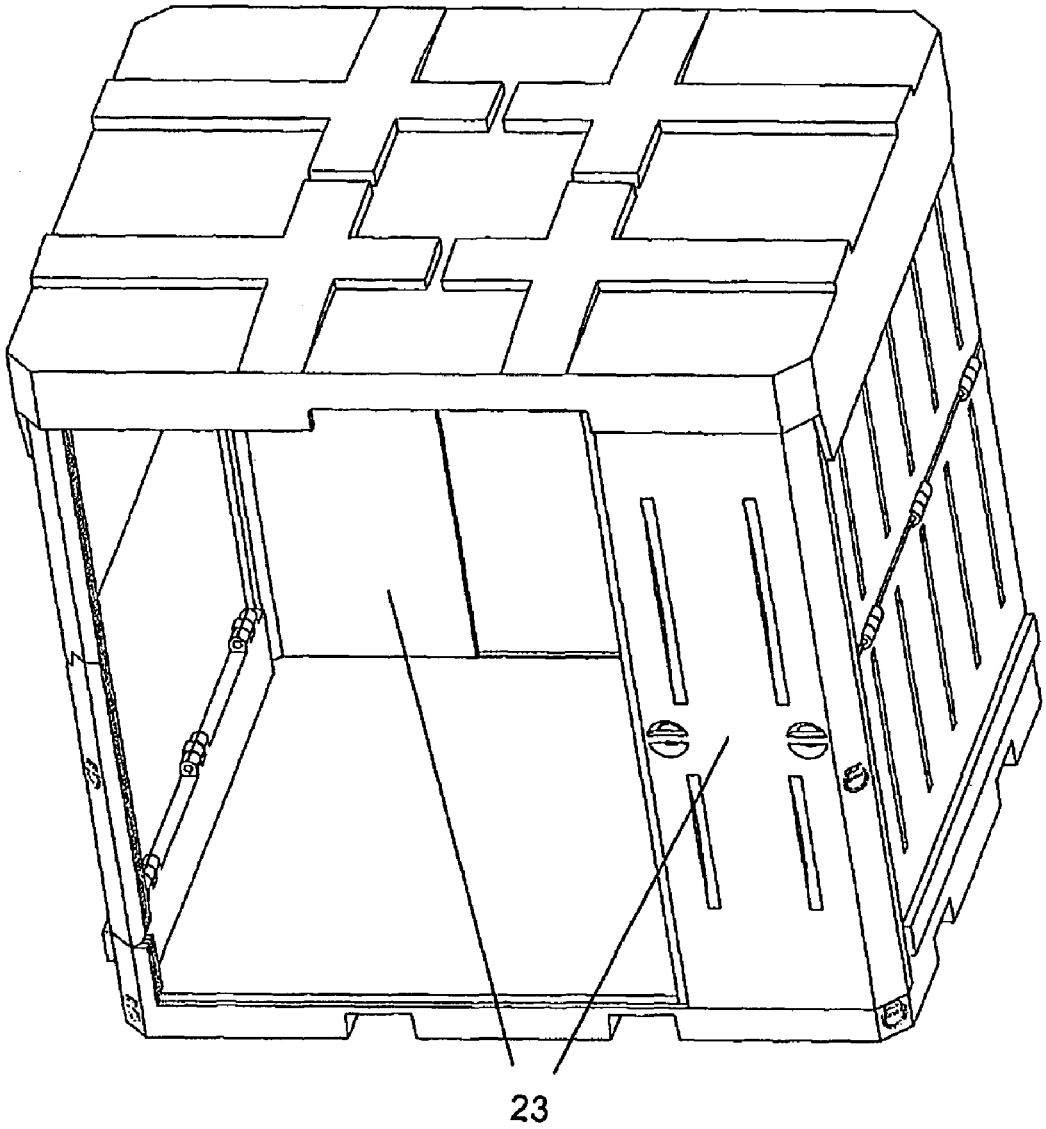
FIG. 11 shows a perspective view of an embodiment of the current invention.

As shown in FIG. 11, the side wall panels 23 provide structural support for an erected container, when the side wall panels 21 and 22 have been removed to provide access to the container.

In a preferred embodiment of the current invention, the tongue and groove means between the side wall panels and the roof will have at least one section dimensioned to loosely engage a side wall panel aligned with the section, so that a side wall panel can be removed from the container when aligned with the section.

With reference to FIGS. 4*a* and 4*b*, the section 120 in each upper groove 75, is dimensioned to allow upward displacement of side wall panels 21 and 22 when aligned with the section. Upward displacement of a side wall panel allows for disengagement of the tongue and groove means holding the side wall panel in place between the roof 5 and the base 10. As a result, side wall panels 21 and 22, which are laterally slidable in grooves 75 and 105, can be removed from the container by alignment with the section 120 followed by disengagement of the tongue and groove means by upward displacement. The location of section 120 is indicated by a cutout portion 131 in the side skirting walls 70. The side wall panels 23 have an L-shaped cross section and are not laterally slidable for alignment with the section 120. To permit removal of side wall panel 23, a section 121 aligned with each side wall panel 23 is present in each upper groove 75. The section 121 permits upward displacement of the side wall panels 23 thereby disengaging the tongue and groove means so that side wall panels 23 can be removed from container 1.

The container has at least one locking means that prevents upward displacement of a side wall panel that is in alignment with a section dimensioned to loosely engage a side wall panel (i.e. sections 120 and 121) so that the side wall panel cannot be removed from the container.

In an embodiment, the locking means comprises one or more than one dead bolt, which locks adjacent side wall panels to one another.

Figure 12A:
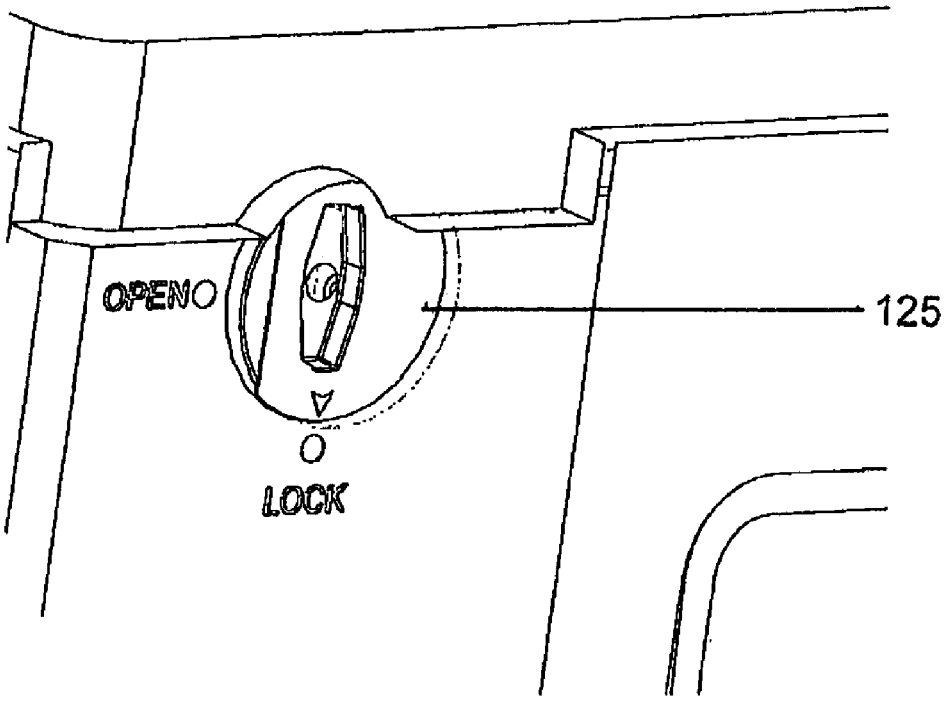
FIGS. 12*a* and 12*b* show perspective views of a locking means in an embodiment of the current invention.
Figure 12B:
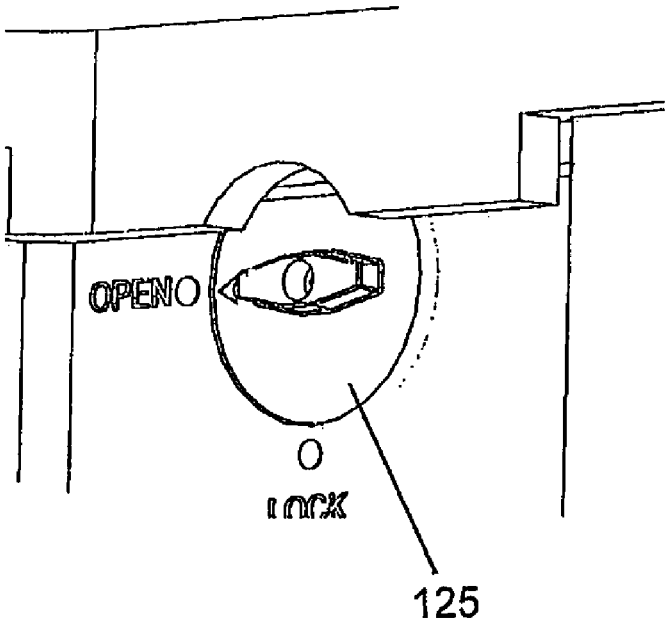

In another embodiment, the locking means is a cam disk 125 in communication with a side wall panel and a section dimensioned to loosely engage a side wall panel. The cam disk is rotatable between a locked position and an unlocked position as shown in FIGS. 12*a* and 12*b* respectively. When in a locked position, the cam disk 125 reduces the vertical dimension of the section dimensioned to loosely engage a side wall panel, to block upward displacement of a side wall panel. When in an unlocked position, the cam disk 125 does not alter the dimensions of the section dimensioned to loosely engage a side wall panel, thereby allowing upward displacement of a side wall panel.

In one embodiment of the invention, the cam disk can be rotatably attached to a side wall panel adjacent to or within the upper tongue and groove means.

A combination of dead bolts and cam disk locks can also be used in the present invention, as can other locking means that are well known in the art.

In an embodiment of the current invention, the end skirting walls of the roof have downwardly extending flanges 132 which overhang the end walls when the container is erect and which seal the ends of a collapsed container by a mating or abutting engagement with the retaining walls of the base. In a preferred embodiment, the retaining walls 100 have a lip 133 that engages the flanges 132 on the roof when the container is collapsed. The flanges 132 help to waterproof the container 1.

In order to facilitate movement of container 1, the base has base cut outs 135 which accommodate a pair of tines or prongs approaching the container along an axis substantially perpendicular to the side walls or substantially perpendicular to the end walls. The cut outs 135 form depending tine slots and can be integrally molded in base 10 with spacing to accommodate the tines of a forklift, a hand push pallet mover or hand jack or other suitable device having tines which engage complimentary slots.

The roof can have protrusions 140 which are complimentary to the cut outs 135 in the base, so that a plurality of collapsed or erect containers may be stacked one on top of the other without slippage. Optionally, a gully 145 can be provided in the protrusions 140 of roof 5 to allow liquid to escape a confined area 150 defined in the roof by the protrusions.

In an embodiment of the invention, at least one of the ends walls has a plurality of rain proof cutouts 155 comprising upwardly deepening vertical troughs which extend from an upper end of the end wall 15 to below the bottom edge of the downwardly extending flanges 132. The troughs provide airflow into erect container 1 while the shape of cutouts 155 prevents water from entering the container 1.

In an embodiment, the top surface 80 of the base 10 immediately inward of lower groove 105 is vertically higher than the top surface 80 of the base 10 immediately outward of lower groove 105, so that liquid entering the lower groove 105 will not flow into the container 1. Optionally, the lower grooves 105 may contain drainage holes.

The side wall panels 21-23 and the end wall panels can have one or more than one handle.

The hinges 41, 42 and 43 can be made of rotomolded plastic. The hinges 40, 41 and 42 have male and female components that can be optionally integrally molded with the upper and lower end wall panels, the roof or the base.

The incorporation of an insulating material between the inner and outer wall members 45 and 50 respectively, of each twinned wall component is also contemplated by the current invention.

The base 10 can be reinforced by any method known in the art to strengthen plastic pallets, including for example the incorporation of metal, plastic or composite reinforcing bars, ribbing, columns, posts or studs.

The dimensions of the container are not of particular importance, however, by way of example only, the container can be 8 feet high by 8 feet wide by 6 feet deep. In a another non-limiting embodiment the minimize size of the container will be 6 feet high by 4 feet wide by 6 feet deep.

The load bearing capacity of container 1 will depend on the dimensions of the container, but by way of example only, a container with the dimensions 8 feet high by 8 feet wide by 6 feet deep, will have a load bearing capacity of up to about 3000 lbs.

The weight of an unloaded erect or collapsed container of the current invention will depend on the dimensions of the container, but by way of example only, the weight of a container 8 feet high by 8 feet wide by 6 feet deep, will be less than 2500 lbs, preferably from about 500 to 1500 lbs.

The container 1 can be moved using standard hand pushed pallet movers or hand jacks. A forklift, crane or other especially heavy equipment is not a requirement for moving the container 1, although they may also be used.

Figure 13:
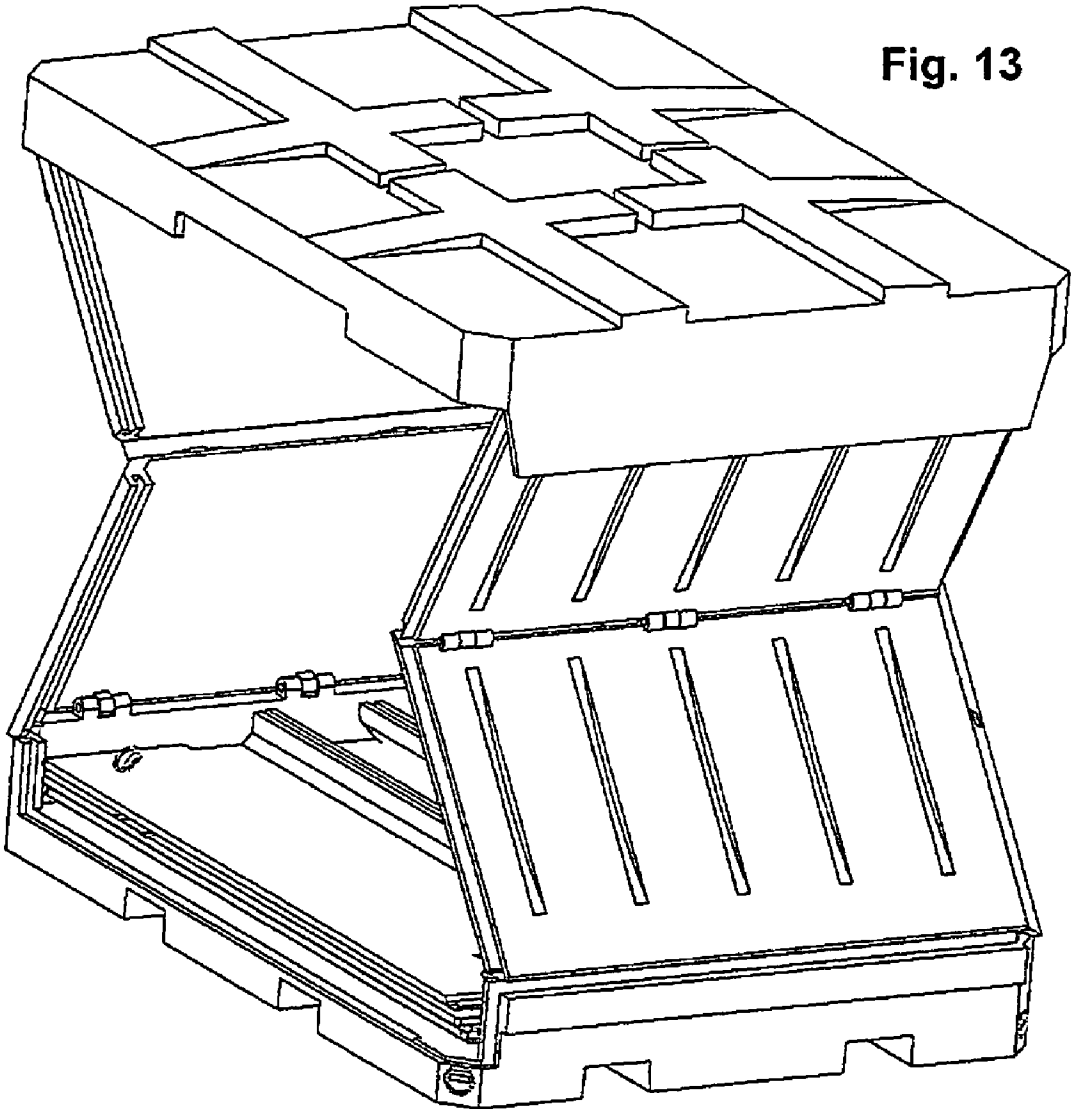
FIG. 13 shows a perspective view of an embodiment of the current invention.
Figure 14:
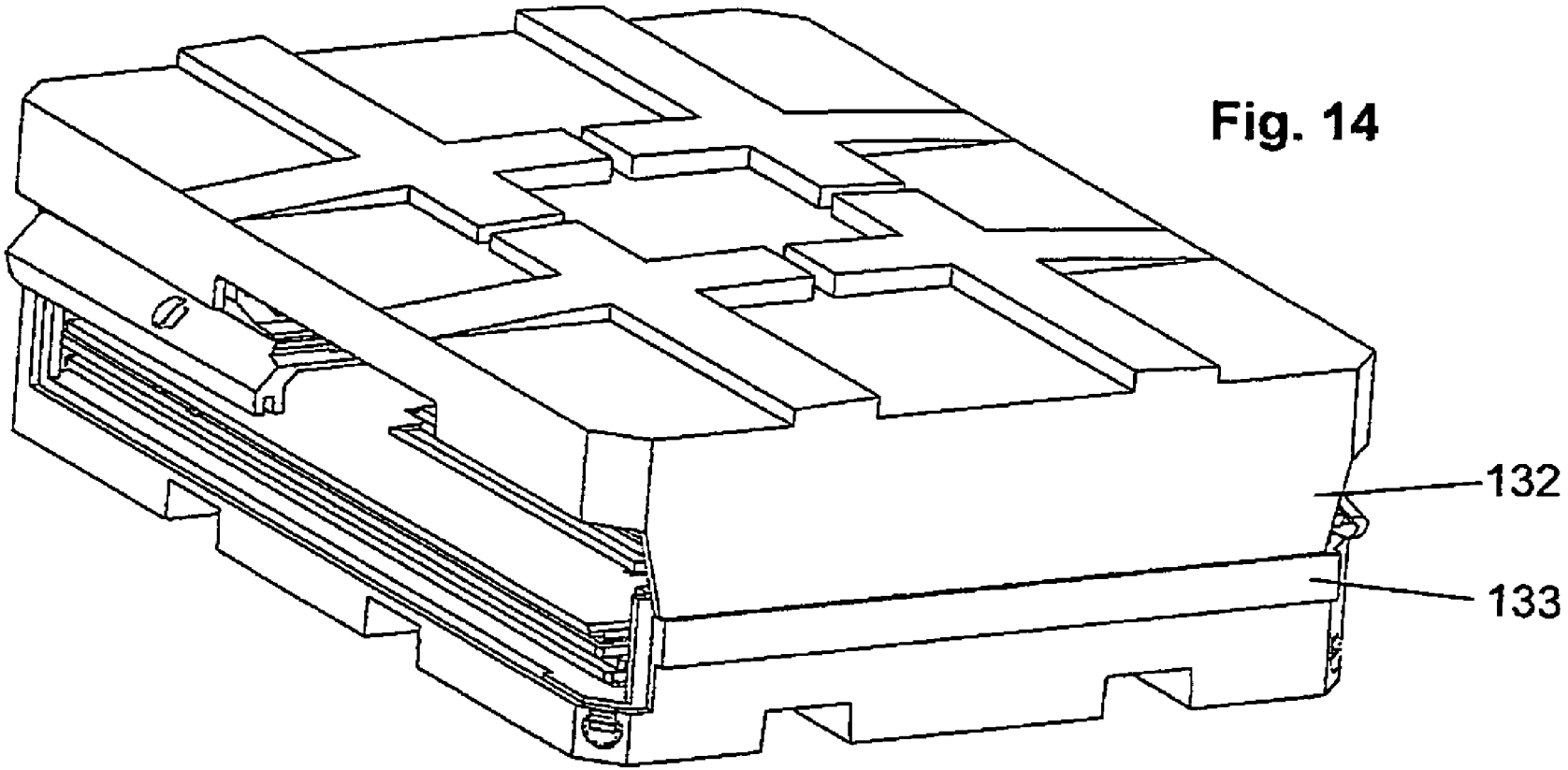
FIG. 14 shows a perspective view of an embodiment of the current invention.

To collapse the container the side wall panels are removed, followed by inward folding of each end wall along horizontal axes 35, to draw the roof 5 closer to the base 10. A partially collapsed container is shown in FIG. 13. The fully collapsed state of container 1 is shown in FIG. 14. Optionally, the side wall panels can be placed in the recessed area between the upwardly extending end retaining walls 100 on the top surface 80 of the base 10 before the container is collapsed. This allows the side wall panels to be stored within the collapsed container.

To erect the container, the above steps are reversed: the roof 5 is lifted away from the base 10, causing the end walls 15 to fold outward until they are substantially vertical. Next, the side wall panels are fed through a section in each upper groove 75, which is dimensioned to loosely engage a side wall panel, in order to engage the tongue and groove means. Optionally, only side wall panels of the type having an L-shaped cross section (i.e. side wall panels 23) are added to the container in order to leave openings for access to the interior of an erected container. Optionally, side wall panels having a generally flat shape (i.e. side wall panels 21 and 22) are also added to partially close or fully close the container.

The roof 5 can be lifted manually, with a forklift, a jack or other suitable means. For example, a forklift can be used to erect the end walls, followed by the addition of at least one side wall panel to maintain the container in an erected position. The method used by a person skilled in the art to erect the container will depend on the dimensions and weight of the container.

It will recognized by persons skilled in the art, that the above description represents only specific embodiments, and that various modifications can be made without diverging from the scope of the invention described.

What is claimed is:

1. A collapsible container comprising:

a roof;

a base;

two opposing end walls, each end wall comprising an upper and a lower end wall panel pivotally attached to said roof and said base respectively, said upper end wall panel being horizontally pivotally attached to said lower end wall panel to permit inward folding of each of said end walls;

two opposing removable side walls fitting between said roof and said base;

said end walls and said side walls being a twinned wall structure defined by inner and outer wall members made of plastic;

wherein each of said side walls is partitioned into first, second, and third sequentially adjacent side wall panels, each of said side wall panels engaging said roof and said base along adjacent edges by complimentary tongue and groove means, wherein a groove in each tongue and groove means between said roof and said side wall panels has one or more sections dimensioned to permit upward displacement of said first, second and third side wall panels, so that said first, second and third side wall panels can be removed from said container when aligned with said one or more sections by disengaging said first, second and third side wall panels from the tongue and groove means between said base and said side wall panels;

whereby said container is collapsible by removing said side walls and inwardly folding said end walls to draw said roof closer to said base.

2. The container of claim 1, further comprising at least one locking means which prevents removal of said first, second or third side wall panels when aligned with said one or more sections; said locking means preventing upward displacement of said first, second or third side wall panels when in a locked position, and allowing upward displacement of said first, second or third side wall panels when in an unlocked position.

3. The container of claim 2, wherein said lower end wall panels are pivotally attached to end retaining walls extending upwardly from said base.

4. The container of claim 3, wherein said end walls, said end retaining walls and said side walls have, along one lateral edge, a corner extension.

5. The container of claim 4, wherein said corner extension on said end walls and said end retaining walls engages an adjacent edge of said side walls by a tongue and groove interaction, and wherein said corner extension on said side walls engages an adjacent edge of said end walls by a tongue and groove interaction.

6. The container of claim 5, wherein at least one of said side walls and said end walls has a plurality of concave indentations, said concave indentations forming an internal arch between said inner and outer wall members.

7. The container of claim 6, wherein said base has depending tine slots.

8. The container of claim 7, wherein said roof has protrusions complimentary to said tine slots so that a plurality of containers can be stacked one on top of the other without slippage.

9. The container of claim 8, wherein said third side wall panels have attached to an upper edge, a rotatable cam lock, said cam lock allowing or preventing removal of said third side wall panels from said container by allowing or preventing upward displacement of said third side wall panels respectively.

10. The container of claim 9, wherein said side walls and said end walls are rotomolded plastic components.

* * * * *